US006086984A

United States Patent [19]

DiMaggio, Jr. et al.

[11] Patent Number: 6,086,984

[45] Date of Patent: Jul. 11, 2000

[54] ELASTIC NONWOVEN FABRIC

[75] Inventors: D. Paul DiMaggio, Jr., Atkinson, N.H.; Nash Abu Saaduh, Dracut; Timothy J. Curtis, Lawrence, both of Mass.

[73] Assignee: Delaware Valley Corporation, Lawrence, Mass.

[21] Appl. No.: 09/083,644

[22] Filed: May 22, 1998

Related U.S. Application Data

[60] Provisional application No. 60/048,226, May 30, 1997.

[51] Int. Cl.[7] ..... B32B 7/08

[52] U.S. Cl. ..... 428/223; 428/137; 428/298.4; 428/293.4; 428/295.7

[58] Field of Search ..... 428/224, 223, 428/300, 359, 293.4, 364, 365, 372, 913, 285, 286, 137, 138, 256, 284, 299, 403, 220, 298.4, 295.7

[56] References Cited

U.S. PATENT DOCUMENTS

| | | | |
|---|---|---|---|
| 4,258,097 | 3/1981 | Bencdyk . | |
| 4,652,487 | 3/1987 | Morman . | |
| 4,657,802 | 4/1987 | Morman | 428/152 |
| 4,663,220 | 5/1987 | Wisneski et al. | 428/221 |
| 4,692,371 | 9/1987 | Morman et al. . | |
| 4,741,944 | 5/1988 | Jackson et al. | 428/152 |
| 4,775,579 | 10/1988 | Hagy et al. | 428/284 |
| 4,977,011 | 12/1990 | Smith | 428/152 |
| 5,077,874 | 1/1992 | Trask et al. . | |
| 5,199,141 | 4/1993 | Trask et al. . | |
| 5,244,482 | 9/1993 | Hassenboehler, Jr. et al. | 55/528 |
| 5,260,126 | 11/1993 | Collier, IV et al. | 428/288 |
| 5,306,545 | 4/1994 | Shirayanagi et al. | 428/198 |

OTHER PUBLICATIONS

Kraton Thermoplastic Rubber, Typical Properties, 1992, Shell Chemical Company (Excerpts from two Kraton Brochures).

*Engage POE's* brochure, The Dow Chemical Company.

Thomas Gries et al., Novel air–jet covered yarns for woven elastic fabrics, 1994 Aachen Textile Conference.

*DuPont Fibers,* Technical Information, Bulletin LL–86, Dec. 1976.

Rattner, David, Thermal Bonding Principles and Application, Aztec Machinery Company, Nonwoven Fabrics Forum, Jun. 23–35, 1987.

Collier et al., *Recoverable Stretch Nonwoven Containing Elastic Fibers,* No. 5,260,126.

Wadsworth, et al., *Stretchable Fabric Technology Options,* Nonwovens World, Spring 1994.

Modification of Thermoplastics with Kraton Polymers, Shell Chemical Company.

Hassenboehler, Charles B., et al., Expanding Roll Goods Value by East Stretch Processing, Nonwovens World, IDEA 98 Show Issue—Apr. 1998.

*Primary Examiner*—Merrick Dixon
*Attorney, Agent, or Firm*—Bromberg & Sunstein LLP

[57] ABSTRACT

A dry laid nonwoven needlepunched fabric held together by elastic weld joints and a method for making the same. The fabric is made with binder fibers that have been modified to include an elastomeric component. Binder staple fibers and higher melt staple fibers are mixed, dry laid, layered and needlepunched to form a flat web. The web may be put through a structuring loom to produce a fabric with a textured outer surface formed by loops or raised strands of the higher melt fiber. The fabric is thermal bonded so as to form the weld joints that hold the higher melt fibers into the base of the fabric. The elasticity of the weld joints results in an elastic fabric.

28 Claims, 2 Drawing Sheets

ELASTIC NONWOVEN FABRIC

This application claims priority from U.S. Provisional Application Ser. No. 60/048,226 now abandoned, filed May 30, 1997, the full disclosure of which is hereby incorporated by reference herein.

BACKGROUND OF THE INVENTION

The present invention is generally related to nonwoven fabrics, in particular, to dry laid needlepunched nonwoven fabrics.

There has been a continuing need to impart elasticity or stretchability to nonwoven fabrics to allow them to more closely approximate the drape, hand and flexibility of woven or knit textile fabrics. As a practical matter, the process of adding stretch to a nonwoven fabric must be done at low cost so that the cost advantage of nonwoven fabric over the more traditional textile fabrics is not lost.

Several nonwoven fabric applications for automotive use would benefit from the addition of stretch to the nonwoven fabric. For example, seat covers would benefit from a nonwoven fabric that can be stretched over a seat frame and will automatically relax to its original shape without sags or stretch marks. A partially elastic nonwoven fabric would be advantageous for use in door panel trim or headliners where deep contours may be smoothly fit with the stretchable fabric without gathers, puckers or a tendency to lift away from a deep contour. Dry laid nonwoven needlepunched fabrics are distinct from nonwoven fabrics obtained through other processes such as spun bonded, melt blown or wet laid. These other processes are generally used for more compact and lighter weight materials. Spunbonding uses continuous fibers rather than staple fibers. Dry laying tends to permit more voluminous and higher weight fabrics. Dry laying further permits, due to the staple fibers, additional processing such as needlepunching in a texturing loom to obtain a textured surface since the fibers are free to move into the pile surface. While the low cost of dry laid nonwoven fabrics has been desirable in the automobile industry, the lack of elastic recovery properties in dry laid nonwoven fabrics has been a hindrance to more widespread use. It is an object of the present invention to provide a dry laid nonwoven fabric with elastic properties that overcome the nonelastic limitations of the prior art dry laid needlepunched thermal bonded nonwovens.

SUMMARY OF THE INVENTION

An embodiment of the present invention is a nonwoven fabric held together by elastic weld joints. The fabric includes a nonwoven needlepunched web having a base of interentangled fibers and a face formed by loops of those fibers. The weld joints include an elastomer such as ethylene alpha-olefin or ethylene/butylene-styrene block copolymer.

In accordance with a further embodiment of the invention, a nonwoven web, during processing, includes interentangled higher melt fibers and low melt binder fibers wherein the binder fibers include an elastomeric component. The binder fibers of preferred embodiments are shorter in length than the higher melt fibers and have a smaller denier than the higher melt fibers. The web may be needlepunched to have a structured face of loops of higher melt fibers.

The present invention further includes the method of making the nonwoven fabrics of the invention. An embodiment of the method includes steps of mixing higher melt fibers with binder fibers having an elastomeric component, dry laying the mixture, layering to form a batt, needlepunching the batt and thermal bonding the needlepunched batt.

The present invention permits production of the fabric at a relatively low cost having desirable elastic properties. Other objects and advantages of the present invention will become apparent during the following description of the presently preferred embodiments of the invention taken in conjunction with the drawings.

DETAILED DESCRIPTION OF THE PRESENTLY PREFERRED EMBODIMENTS

Figure 1:
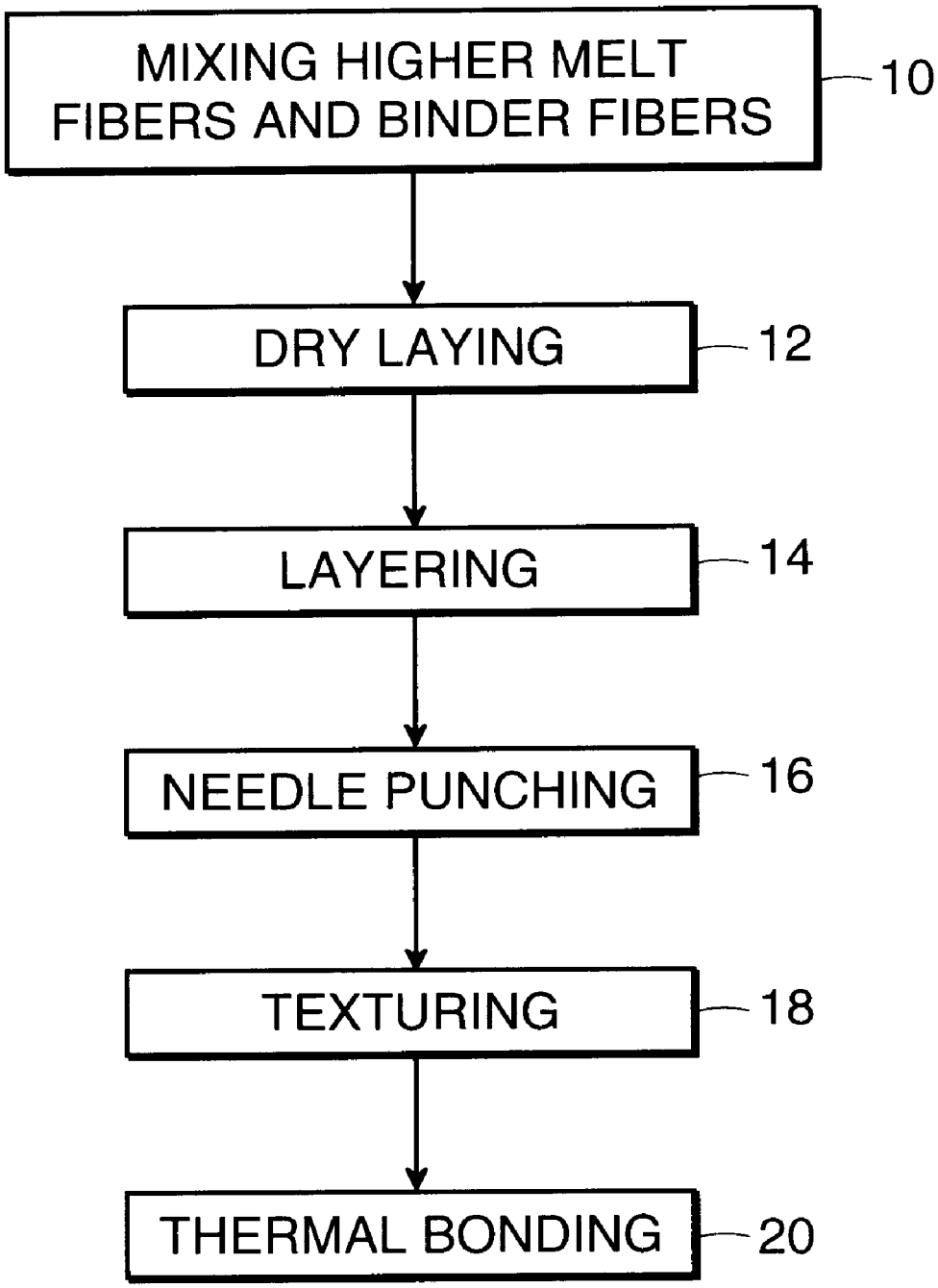
FIG. 1 is a flow chart of the method for making elastic nonwoven fabric of the invention.

The present invention will be better understood by first clarifying the definitions of terms used herein. The term "elastic" has a meaning in terms of the fabric produced. A "moderately elastic fabric" as used herein is one that can be stretched upon application of a force along one of the two larger planes of the fabric (across its width or its length) to a length of 130% of its original relaxed length and upon release of said force will relax back to its original length or to within 105% of its original length. In the other of the planes, the moderately elastic fabric can be stretched to 115% of its original length and upon release will relax back to its original length or to 105% of its original length. A "substantially elastic fabric" is used more restrictively herein to mean a fabric that can be stretched along one of the two larger planes of the fabric to a length of 130% of its original relaxed length and upon release of said force will relax back to its original length or to within 102% of its original length. In the other of the planes, the substantially elastic fabric can be stretched to 115% of its original length and upon release will relax back to its original length or to 105% of its original length. The term "nonwoven needlepunched fabric" means a fabric produced from individual staple fibers being laid one upon another in a more or less random fashion and then being subjected to multiple penetrations by needles with barbs or burrs or the like that cause the fibers to be entangled with one another creating a mechanically entangled web of a type well known in the art. The term "structured" or "textured" as used herein means fabrics produced by further subjecting the nonwoven needlepunched fabric to multiple penetrations by either a fork-shaped needle or a needle with a barb on the end to a depth that causes loops of fiber or strands of fiber to protrude from the surface thus creating a fuzzy or looped surface on one side of the fabric. The term "binder fiber" as used herein means a thermoplastic fiber whose softening point is below the softening point of the higher melt staple fibers it is blending with. Binder fibers can be of any thermoplastic polymer depending upon the higher melt fiber it is used with. Such binder fibers may include polyethylene, polypropylene, nylon 6, polyester and numerous other known fibers. The term "dry laid" refers to the process of taking individual staple fibers and separating them and orienting them in a predominant direction by mechanically combing them in machines called cards or garnets.

The binder fiber for use in the present invention is modified to include an elastomeric component. The binder fiber thus becomes a copolymer. In order to make the binder fiber for the present invention, a low melt fiber is modified by the addition of an elastomeric component such as ethylene alpha-olefin or an elastomeric block copolymer. A specific example of the binder fiber for use in the present invention would be a polyethylene polymer such as that manufactured by Dow Chemical under the trade name Aspun 6835-A, modified by the addition of either Engage™ ethylene alpha-olefin ("E-A/O") polymers made by Dow Chemical or a Kraton® ethylene/butylene-styrene block copolymer ("SEBS") made by Shell Chemical Company. It is recommended that the ratio of the polyethylene binder fiber polymer with the E-A/O or SEBS be in a ratio of between 80% to 40% by weight of the polyethylene to between 20% and 60% by weight of the E-A/O or SEBS. It has been found that at higher levels of the elastomeric component, tackiness of the binder fiber becomes problematic for further downstream textile processing of the fiber. At levels below 20% of the elastomeric component, the elasticity of the final fabric will normally not be great enough to meet the needs of the fabric end user.

One method of making up the modified binder fiber is through a standard fiber extrusion. The elastomeric polymer and the low melt polymer are intimately premixed in a predetermined ratio prior to the extrusion process. Alternatively, the elastomeric component can be co-extruded with the low melt polymer as a bicomponent fiber with a side-by-side or sheath around a core configuration. The homogenous multi-component single filament fiber of blended polymers is the presently preferred binder fiber for use in the invention. The binder fiber after extrusion in any of its forms would normally be drawn, crimped, cut and surface finished by standard methods.

The binder fiber is preferably in a denier that is between about ⅓ the denier up to an equivalent of the denier of the higher melt fiber. The cut length of the binder fiber is preferably ⅓ the length up to an equivalent length of the higher melt fiber. The reason it is preferred that the binder fiber be a smaller length and denier than the higher melt fiber is to provide as many separate binder fibers in the fabric web being processed as is possible for a given weight of the fiber. The large number of binder fibers form dispersed bond sites and encapsulate as many of the high melt fibers at crossover points as is possible to create an efficiently bonded final fabric. The mixture of binder fiber and higher melt fiber will be measured in terms of a weight ratio. Thus, reducing the denier and length of the binder fiber increases the number of binder fibers for a given weight.

The process of making an embodiment of the elastic nonwoven fabric of the invention may now be described. The process begins by providing a modified binder staple fiber with an elastomeric component. Also provided is a higher melt staple fiber. For example, a binder fiber of polyethylene modified with E-A/O may be provided along with polypropylene as higher melt fibers. Referring now to FIG. 1, an intimate blend of the modified binder fiber with the higher melt fibers is formed by mixing 10 the two staple fibers. The mixing process 10 is accomplished through any of a number of standard textile fiber opening and blending techniques. Measurement by weight or volume is used to feed the two components into picking machines and subsequently into blending bins. Intimate mixing of the two fibers is often the key to the performance of the final fabric product. It is generally preferred that the binder fiber be blended with the higher melt fiber in a ratio to achieve a final fabric that is 5% to 25% by weight binder fiber.

From the blending bin, the fiber blend is transported to a card or garnet or air former where it is carded or combed or air laid into a web of fiber. This step is referred to herein as dry laying 12. Subsequently, this web is layered 14, for example by crosslapping, and thus built up into a batt of the proper weight needed for the desired finished fabric. The layered batt is then mechanically entangled through needlepunching 16. This process generally produces a standard dry laid nonwoven needlepunched fabric that is within 5–15% of the desired weight per square yard of the final product. Automotive fabric, such as seating fabrics, headliner fabrics and door panel fabrics, require weights in the range of 2 oz. per sq. yd. to 14 oz. per sq. yd. If a flat finished surface is desired, a final finish needling is done with conventional flat needling looms to bring the overall needle penetrations per inch up to 1500–3500. If a textured surface is desired, the next step in the textile production is the creation of the textured surface on the nonwoven needlepunched fabric.

Texturing 18 as that term is used herein gives the fabric a warmer aesthetic appearance. The surface texture is created in a texturing or structuring loom. Texturing is performed on any of several types of nonwoven structuring machines such as those represented by Dilo, Inc.'s DiLoop machine, DiLoft machine or DiLour machine. These are three examples of structuring machines available today. The present invention, however, does not necessarily require texturing. If textured to form loops or loose strands of higher melt fibers, any of these machines or other machines capable of producing the textured surface may be used.

Figure 2:
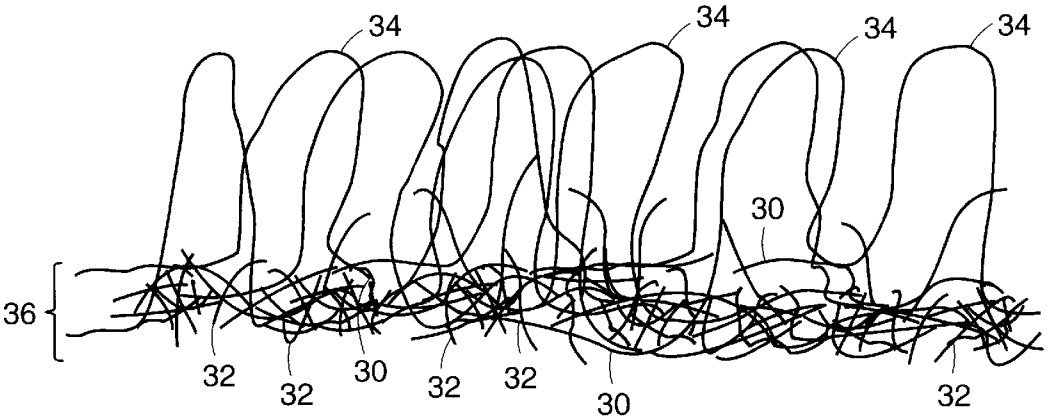
FIG. 2 is a rough sketch of a magnified cross-sectional view of a fabric of the invention prior to thermal bonding.

The texturing step 18 forms loops or raised strands of higher melt fibers 30 in the outer surface of the carpet. Loops 34 are shown in FIG. 2. These loops have been pushed out from the entangled base 36 of the web. In the base 36, the binder fibers 32 and higher melt fibers 30 are interentangled. During texturing, predominantly the higher melt fibers 30 are forced into the outer surface as loops. Some binder fibers 32 may make their way into the outer surface, but it has been found that the higher melt fibers 30 are more likely to be pushed than the low melt fibers because of the length, denier and toughness generally associated with the higher melt fiber 30. The texturing step may produce a fabric that has any of a number of surface finishes including velour, ribbed, plush, knob or patterned finish.

Figure 3:
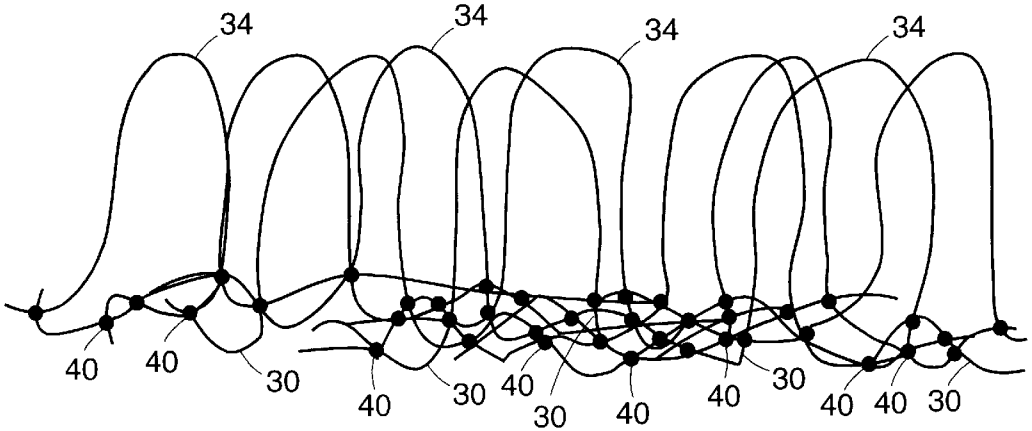
FIG. 3 is a rough sketch of a magnified view of the cross-section of the fabric of the invention after thermal bonding.

The textured fabric is then thermal bonded 20 to give it its final integrity. Thermal bonding involves the application of heat to the fabric in order to melt the binder fiber 32. The fabric is raised above the softening point and melting point of the binder fiber 32, yet is maintained below the softening point of the higher melt fiber 30. The heating may take place by any of a number of conventional methods including the application of hot air, infrared, microwave, etc. Thermal bonding methods are discussed by David Rattner in the paper "Thermal Bonding Principles and Applications", 1987 Fabrics Forum, Clemson University, the disclosure of which is hereby incorporated by reference herein. After the softening point temperature of the binder fiber 32 has been reached, most, if not all the binder fibers relax and contract upon their major axis until they encounter enough mechanical resistance to their free movement during contraction. Then, bonds form at crossover points or intersections with other fibers as shown in FIG. 3. The binder fibers 32 have been sufficiently heated to form globules that encapsulate higher melt fibers 30 at the latter's crossover points. These globules are referred to herein as weld joints 40. Upon cooling, these globules solidify encapsulating and binding the higher melt fibers 30 to one another. The bonding process may cause some overall shrinkage of the fabric and thus an increase in weight per square yard. On the other hand, a tenter frame may be used in conveying the fabric. The tenter frame may be used to stretch the fabric thereby offsetting the shrinkage tendencies of the bonding process.

In accordance with the present invention, the weld joints 40 share the elastic properties of the elastomeric component of the binder fiber 32. Thus, the resulting fabric is advantageously at least moderately elastic and preferably substantially elastic. The elastic fabric has the ability to stretch and return approximately to its relaxed position or shape. The actual bonding points 40 created at the crossover points of the higher melt fibers 30 are thus partially elastic at low stress levels and allow the higher melt fibers 30 to pull away from their bond points. When the stress is relieved, the higher melt fibers 30 are partially pulled back to their point of bond by the elastic properties of the elastomeric component of the binder fiber. Thus, to a certain degree, elasticity has been added to the nonwoven fabric. A magnified cross-section of such a fabric is shown in FIG. 3.

Although the embodiments hereinbefore described are preferred, many modifications and refinements which do not depart from the true spirit and scope of the invention may be conceived by those skilled in the art. It is intended that all such modifications, including but not limited to those set forth above, be covered by the following claims.

We claim:

1. A nonwoven fabric comprising:

a base of needlepunched interentangled fibers;

a textured face on top of said base, formed by said fibers; and a multiplicity of weld joints interspersed within said base to hold said fibers within the fabric, said weld joints including an elastomeric component in sufficient quantity such that said nonwoven fabric is moderately elastic.

2. The nonwoven fabric of claim 1 wherein said elastic weld joints comprise ethylene alpha-olefin.

3. The nonwoven fabric of claim 1 wherein said elastic weld joints comprise elastomeric block copolymer.

4. The nonwoven fabric of claim 3 wherein said elastomeric block copolymer comprises ethylene/butylene-styrene block copolymer.

5. The nonwoven fabric of claim 1 wherein the textured face is formed by loops of said fibers.

6. The nonwoven fabric of claim 1 wherein the textured face is formed by raised strands of said fibers.

7. The nonwoven fabric of claim 1 wherein said weld joints include elastomeric components in sufficient quantity to make said nonwoven fabric substantially elastic.

8. A nonwoven web comprising:

higher melt staple fibers and low melt binder staple fibers interentangled to form a web, said binder staple fibers have been modified to include an elastomeric component.

9. The nonwoven web of claim 8 wherein said binder staple fibers are shorter in length than said higher melt staple fibers.

10. The nonwoven web of claim 8 wherein said binder staple fibers have a smaller denier than said higher melt staple fibers.

11. The nonwoven web of claim 8 wherein said elastomeric component comprises ethylene alpha-olefin.

12. The nonwoven web of claim 8 wherein said elastomeric component comprises an elastomeric block copolymer.

13. The nonwoven web of claim 12 wherein the elastomeric block copolymer comprises ethylene/butylene-styrene block copolymer.

14. The nonwoven web of claim 8 wherein 20 to 60% by weight of said binder staple fiber is said elastomeric component.

15. The nonwoven web of claim 8 wherein said web further includes a textured face of loops of higher melt staple fibers.

16. The nonwoven web of claim 8 wherein said web further includes a textured face of raised strands of higher melt staple fibers.

17. A nonwoven fabric comprising:

a nonwoven needlepunched web, said web having a base of interentangled polypropylene fibers and a textured face formed by said polypropylene fibers; and a multiplicity of weld joints formed from polyethylene interspersed within the base of said polypropylene web to hold said fibers within said web, said weld joints further including an elastomeric component in sufficient quantity such that said nonwoven fabric is moderately elastic.

18. The nonwoven fabric of claim 17 wherein said elastomeric component comprises ethylene alpha-olefin.

19. The nonwoven fabric of claim 17 wherein said elastomeric component comprises elastomeric block copolymer.

20. The nonwoven fabric of claim 19 wherein said elastomeric block copolymer comprises ethylenelbutylene-styrene block copolymer.

21. The nonwoven fabric of claim 17 wherein said weld joints include elastomeric components in sufficient quantity to make said nonwoven fabric substantially elastic.

22. A nonwoven web comprising:

polypropylene staple fibers and polyethylene binder staple fibers interentangled to form a web, said polyethylene fibers being modified with an elastomeric component.

23. The nonwoven web of claim 22 wherein said elastomeric component comprises ethylene alpha-olefin.

24. The nonwoven web of claim 22 wherein said elastomeric component comprises an elastomeric block copolymer.

25. The nonwoven web of claim 24 wherein the elastomeric block copolymer comprises ethylene/butylene-styrene block copolymer.

26. The nonwoven web of claim 22 wherein 20 to 60% by weight of said polyethylene binder staple fiber is said elastomeric component.

27. The nonwoven web of claim 22 wherein said web further includes a textured face of loops of polypropylene staple fibers.

28. The nonwoven web of claim 22 wherein said web further includes a textured face of raised strands of polypropylene staple fibers.

* * * * *

UNITED STATES PATENT AND TRADEMARK OFFICE

CERTIFICATE OF CORRECTION

PATENT NO. : 6,086,984

DATED : July 11, 2000

INVENTOR(S) : D. Paul DiMaggio, Jr., Nash Abu Saaduh, and Timothy J. Curtis

It is certified that error appears in the above-identified patent and that said Letters Patent are hereby corrected as shown below:

Col. 5, line 51, change "have" to --having--

Col. 6, line 31, change "ethylenelbutylene-styrene" to --ethylene-butylene-styrene--

Signed and Sealed this

First Day of May, 2001

*Attest:*

Nicholas P. Godici

NICHOLAS P. GODICI

*Attesting Officer*

*Acting Director of the United States Patent and Trademark Office*